United States Patent [19]

Kaipf et al.

[11] 4,444,360

[45] Apr. 24, 1984

[54] WEB SEVERING APPARATUS IN A WEB WINDING MACHINE

[75] Inventors: Walter Kaipf, Haunsheim; Herbert Ulmer, Heidenheim, both of Fed. Rep. of Germany

[73] Assignee: J. M. Voith GmbH, Heidenheim, Fed. Rep. of Germany

[21] Appl. No.: 353,979

[22] Filed: Mar. 2, 1982

[30] Foreign Application Priority Data

Mar. 13, 1981 [DE] Fed. Rep. of Germany ..... 3109587

[51] Int. Cl.[3] ..... B65H 19/20

[52] U.S. Cl. ..... 242/56 R; 242/66

[58] Field of Search ..... 242/56 R, 66, 56.6; 83/610, 611, 612, 382

[56] References Cited

U.S. PATENT DOCUMENTS

| | | | |
|---|---|---|---|
| 3,365,942 | 1/1968 | Dreher | 242/56 R X |
| 3,845,914 | 11/1974 | Straujups | 242/56 R |
| 4,331,301 | 5/1982 | Martinez | 242/56 R X |
| 4,339,092 | 7/1982 | Benoy et al. | 242/56 R |
| 4,345,722 | 8/1982 | Kuhn | 242/56 R |
| 4,368,855 | 1/1983 | Schönmeier et al. | 242/56 R |
| 4,370,193 | 1/1983 | Knauthe | 242/66 X |

FOREIGN PATENT DOCUMENTS 2920707 12/1980 Fed. Rep. of Germany .

*Primary Examiner*—Stuart S. Levy
*Assistant Examiner*—David Werner
*Attorney, Agent, or Firm*—Louis H. Reens; Ronald J. St. Onge

[57] ABSTRACT

A web severing apparatus is described which is operative between support rollers and a web wind-up roll employed in a web winding machine. The web severing apparatus consists of a retractable beam which is guided on axial ends of the support rollers. The beam has at its upper end a pivotably arranged mounting on which a web tear-off blade is screwed. The mounting further supports at a small distance away from the web tearing blade, a web holding element having a web contacting surface to clamp the web firmly on the roller when the web tear-off blade is so positioned relative to the web contacting surface that a narrow gap is formed between the web tearing edge of the blade and the web. When the web wind-up roll is then pushed out over one of the support rollers, the web is pulled against the web tear-off blade and is severed. With such web severing apparatus, the surface of the support roller opposite the blade and the web tear blade are protected from damage.

7 Claims, 3 Drawing Figures

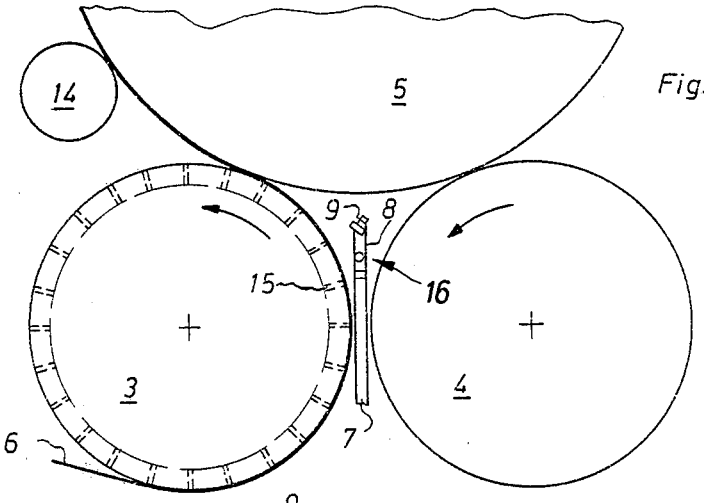
Fig. 1
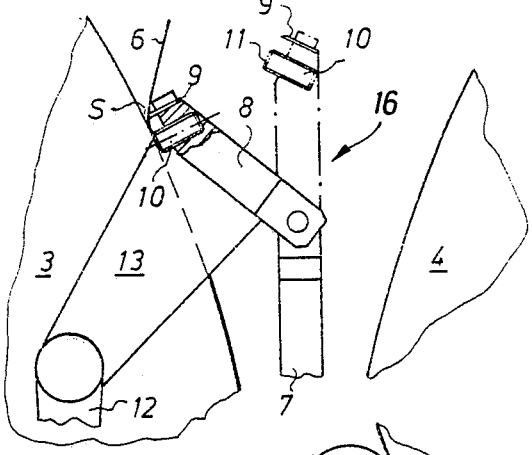
Fig. 3
Fig. 2
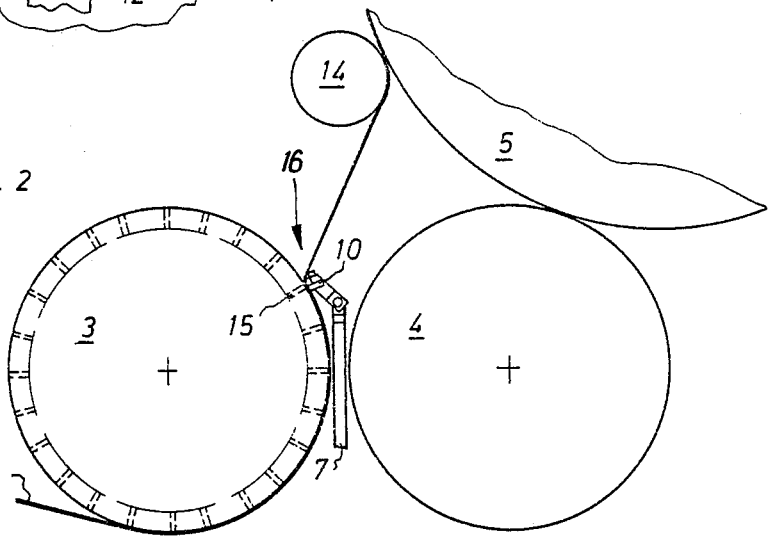

WEB SEVERING APPARATUS IN A WEB WINDING MACHINE

FIELD OF THE INVENTION

This invention generally relates to a web winding machine and more particularly to an apparatus for severing a web of material such as paper or fabric and the like in a web winding machine of the type having double support rollers for a spool on which the web is wound.

BACKGROUND OF THE INVENTION

A web winding machine is known in which a toothed perforated web cutting device is inserted from below and between support rollers, when these have been stopped, and into a wedge-shaped space formed between the support rollers and the spool on which the web material is wound. The web cutting device is pressed against the web at a place where it is looped part of the way around one of the support rollers. Hence, when a wound, finished roll of the web is subsequently lifted away from the one support roller over the second support roller, the web is torn off against the toothed web cutting device, along its line of perforations. During this severance, the arriving leading segment of the web is firmly held onto the roller via bores in the roller casing, by maintaining inside the support roller a low pressure which is transmitted to one side of the web through bores in the casing of the roller (see German Laid-Open Patent Application Specification No. 29 20 707).

This known arrangement for severing a web has a serious disadvantage introduced by pressing the toothed perforating web tearing device against the support roller thereby not only blunting the toothed perforating device, but in time also damaging the surface of the support roller.

SUMMARY OF THE INVENTION

In a web severing apparatus in accordance with the invention, the tearing edge of a web tearing element, when it is in its web severing position, is spaced from the peripheral surface of a support roller around which the web is looped while a web holding element having a generally flat web engaging surface at a small distance from the web tearing element presses the web against the roller.

When a completed roll of web is wound on a spool, the finished roll is rolled away while the web remains firmly pressed against the support roller by the web holding element without a danger of damage to the surface of the support roller. Since during the severing process, the tearing edge of the web tearing element is kept away from the surface of the support roller there is no danger that the web tearing element will be damaged.

As described further herein, the web holding element preferably has an elastic surface to yieldingly contact the web. The web tearing element preferably is formed as a toothed perforated blade, the tearing edge of which, in the web severing position, is maintained a small distance from the support roller, as small as of the order of about a few tenths of a millimeter. The web holding element may have a continuous web contacting surface, or it may be formed of individual separated segments spread along the length of the element. Preferably, the web contacting surface consists of a single felt material or several pieces of felt.

A web severing device in accordance with the invention enables one to advantageously and precisely set the distance between the support roller and the tearing edge of the web tearing element in its web severing position. This may be obtained with threaded bolts having flat bolt ends passed through a mounting with the flat bolt ends acting as the web holding element to seat on the web. A plurality of such bolts are arranged on the mounting and are distributed across the axial width of the support roller against which the web is to be pressed.

It is, therefore, an object of the invention to provide, in a web winding machine, a web severing apparatus with which damage and wear both to the web severing apparatus and other parts of the web winding machine is avoided.

BRIEF DESCRIPTION OF THE DRAWINGS

These and other objects and advantages of the invention will be more readily understood by means of an illustrative embodiment which is described below with reference to the accompanying drawings, in which:

FIGS. 1 and 2 are schematic side views of a web winding machine employing double support rollers and a web severing apparatus according to the invention in different operating positions; and FIG. 3 is an enlarged schematic side view of the web severing apparatus during its severance of a web.

DETAILED DESCRIPTION OF EMBODIMENT

With reference to FIGS. 1–3, a fully wound roll 5 of web is shown resting on a pair of support rollers 3 and 4 of a web winding machine. The arriving web 6 is looped part-way around the support roller 3 and is shown prior to the web's severance from the finished roll 5. Although normally retracted below the two support rollers 3, 4 a web-severing apparatus 16 is shown in FIG. 1 already raised up into the wedge-shaped space formed between the support rollers 3 and 4 and the roll 5.

The web severing apparatus 16 consists of a beam 7 guided on both sides and having pivotably arranged on its upper end a mounting 8 onto which a web tearing blade 9 is screwed. Web tearing blade 9 has a web tearing edge which can be made in a known manner with a toothed edge. At a small distance from the web tearing blade 9 there is a web holding element 10 constructed with a plurality of bolts which are distributed across the axial width of web tearing blade 9 and are screwed into mounting 8. The web holding elements 10 are provided with felt contact surfaces 11 at the bolt ends nearest to roller 3. The mounting 8 can be pivoted from a web feeding position as shown in FIG. 1 towards a web severing position at roller 3 by means of laterally located rods 12 which act on levers 13 rigidly connected to the mounting 8 as shown in FIG. 3.

In the web severing position, the holding element 10 clamps the web 6 firmly against roller 3, while a small gap s remains between the web tearing edge of blade 9 and the web 6. When, as shown in FIG. 2, the roll 5 is moved over the second support roller 4 by a pushing-out roller 14, the web 6 is pulled against the web tearing edge of blade 9 causing web 6 to be torn off from the finished wound roll 5 so that the latter can be transported away.

A vacuum is now created inside support roller 3 to act through bores 15 in the casing of support roller 3 to firmly hold the web 6, thus enabling the web tearing blade 9 to be pivoted away from the web 6 and roller 3. The entire web severing apparatus 16 can then be lowered again in order to make room for the insertion of a new inner spool above rollers 3, 4 in the space vacated by web severing apparatus 16 and in which the on-coming web 6 is held against roller 3. To begin a winding of the web 6 it is glued to the inner roll spool in a known way, for example, by means of a strip of adhesive applied thereto, and the winding and severing steps repeated.

Having thus described an embodiment for carrying out the invention, its advantages can be appreciated. Variations from the described embodiment can be made without departing from the scope of the claims.

What is claimed is:

1. In a web winding machine in which a spool on which a web is wound is supported by at least a pair of support rollers with the web fed through a space formed between the support rollers and the spool from around at least a portion of the peripheral surface of one support roller and having an apparatus for severing the web, the improvement comprising:

a support member;

web tearing means mounted on the support member on a side thereof to face arriving web;

web holding means mounted on the the support member in proximity to the web tearing means on said side thereof;

said support member with said web tearing means and said web holding means being operatively positioned in the space between the support rollers and the spool;

means for moving the support member with said web tearing means and said web holding means between a position enabling said web to feed and a web severing position where said web holding means presses the web against said portion of the peripheral surface of said one support roller without requiring a lifting away of the spool;

said web tearing means being so located relative to the web holding means as to be spaced a predetermined distance from the peripheral surface of said one support roller when moved to said web severing position so as to enable said web to be severed when a wound spool is being moved away from the support roller against which the web holding means presses the web.

2. The apparatus as claimed in claim 1, wherein said web holding means is provided with a flat web contacting surface.

3. The apparatus as claimed in claim 2 wherein said web holding means is provided with an elastically yielding web contacting surface.

4. The apparatus as claimed in claim 3 wherein said elastically yielding web contacting surface is provided with a layer of felt material.

5. The apparatus as claimed in claim 1 wherein said predetermined distance between the web tearing means and the web at said web severing position is of the order of about a fraction of a millimeter.

6. The apparatus as claimed in claim 1, 2, 3, 4 or 5 wherein said web holding means is formed of a plurality of threaded bolts having flat ends, said bolts being oriented to contact said web with their flat ends in said web severing position.

7. The apparatus as claimed in claim 6 wherein said bolts are positioned to select said predetermined distance.

* * * * *